US005655249A

United States Patent [19]

Li

[11] Patent Number: 5,655,249

[45] Date of Patent: Aug. 12, 1997

[54] TOOTHBRUSH WITH CONCAVE BRUSHING SURFACE

[76] Inventor: Jian-Ren Li, 1488 Wildlark Drive, Peterborough, Ontario, Canada, K9K 1X4

[21] Appl. No.: 636,973

[22] Filed: Apr. 24, 1996

[51] Int. Cl.[6] ..... A46B 9/04

[52] U.S. Cl. ..... 15/167.1; 15/207.2; 15/DIG. 5

[58] Field of Search ..... 15/167.1, 167.2, 15/207.2, DIG. 5; D4/104–112; 132/308, 309, 311

[56] References Cited

U.S. PATENT DOCUMENTS

| | | | |
|---|---|---|---|
| 1,705,542 | 3/1929 | Ryser | 15/167.1 |
| 2,043,898 | 6/1936 | Malcolm | 15/167.1 |
| 5,065,470 | 11/1991 | Diamond | 15/167.1 |
| 5,315,731 | 5/1994 | Millar | 15/167.1 |

FOREIGN PATENT DOCUMENTS

| | | | |
|---|---|---|---|
| 642228 | 8/1928 | France | 15/167.1 |
| 2021711 | 11/1970 | Germany | 15/167.1 |
| WO94/09678 | 5/1994 | WIPO | 15/167.1 |

*Primary Examiner*—David Scherbel
*Assistant Examiner*—Terrence Till

[57] ABSTRACT

A toothbrush is described whose head has a different design in comparison to a conventional flat-trimmed toothbrush in that the heights of the bristles are arranged to create a concave cylindrical brushing surface at the free ends of bristles which has a curvature approximating that of a user's frontal dental arch. Moreover, the heights of the interior bristles at the inner rows are further shortened to follow a more concave cylindrical shape or to form a plane surface. The toothbrush of this design is an improvement to the conventional flat-trimmed toothbrush in terms of dental cleaning and gums stimulation but does not have the drawbacks of the designs found in the prior art.

13 Claims, 6 Drawing Sheets

PRIOR ART

TOOTHBRUSH WITH CONCAVE BRUSHING SURFACE

FIELD OF INVENTION

This invention relates to a toothbrush whose head has a concave cylindrical brushing surface design to suit the outer contours of the user's frontal dental arches. Also, free ends of the bristles at the inner rows away from the front and rear ends of the head have a second more concave shape or a plane surface so that bristles at the outer rows are in greater heights in comparison to those of the inner rows at the same transverse positions along the longitudinal axis of the head. The toothbrush provides improved removal of dental plague and irritable food debris while massaging and stimulating the gums with even pressure without injury to these tissues.

BACKGROUND ART

The recommended technique to brush the outside surfaces of the teeth at the upper or the lower jaw is to place the toothbrush head horizontally between the lip and the dental arch with the brushing surface facing the dental arch, place the bristles above the gumline, apply gentle pressure against the gums with tiny horizontal movement to massage the gums and to dislodge the dental plaque and debris, sweep the bristles downwards along the length of the teeth towards biting ends.

The same technique is used for brushing the inside surfaces of the teeth at the upper and lower jaws. Due to the obstruction of the frontal teeth to the handle of the toothbrush, it is necessary to place the toothbrush and therefore its head inclining upwards for cleaning the inside surfaces of the molars and the premolars at the lower jaw and inclining downwards for cleaning the inside surfaces of the molars and premolars at the upper jaw. Also, it is necessary to use the toothbrush head vertically for cleaning the inside surfaces of the canines and incisors.

The conventional flat-trimmed toothbrush has a flat brushing surface but the human dental arches are of a general parabolic shape. When the conventional flat-trimmed toothbrush is used to brush the outside surfaces of the teeth, the contact area between the toothbrush and the dental arch is limited (FIG. 6). For the toothbrush, the contact area is mostly at the center line of the brushing surface. This often causes an unduly wearing of the bristles at that part (they bend out drastically and can not be easily straightened back). Bristles at other part of the head are less used and thus wasted. The limited contact area of the toothbrush on the dental arch makes brushing inefficient and thorough cleaning is not guaranteed even for people who do systematic and careful brushing. There could be areas on the teeth surfaces which would be left untouched by adjacent apparently overlapping brushing attempts traversing the dental arch. Because the gums also follow the parabolic shape, the limited contact of the flat-surfaced toothbrush with the gums means all the pressure applied to the gums by the toothbrush is concentrated at that small contact area. This causes excessive stress on the gums.

Generally, the tips of the bristles near the front end of a conventional flat-trimmed toothbrush have difficulty accessing the rear parts of the outside surfaces and gums of the second molars in adults and the outside surfaces and gums of the third molars are entirely unaccessible because of the obstruction to the toothbrush head caused by the frontal ridges of the rami of the lower jaw bone (41 in FIG. 6). The brushing surface of the conventional flat-trimmed toothbrush head is unable to reach the back surfaces of the last molars.

For brushing the inside surfaces and gums of the molars at the lower jaw, the flat-trimmed toothbrush is awkward to reach the area around the gumline. This is because the inside surfaces of the molars are inclined to the tongue. With the tongue in place, the toothbrush head has no room for further downward rotation to allow the brushing surface of the head to be in flat contact with the inside surfaces of the molars. When brushing the inside surfaces of the frontal teeth both at the upper and the lower jaw, with the toothbrush head placed vertically, the bristles scratch at the slanted parts of the inside surfaces of the teeth but may actually overpass the recessed areas around the gumlines. These are the shortcomings of the conventional flat-trimmed toothbrush.

Modifications to the shape of the brushing surface of the conventional flat-trimmed toothbrush to create a concave cylindrical contour to suit the dental arches are known in the prior art, for example, the Cheng toothbrush, U.S. Pat. No. 4,712,267, The Millar toothbrush, U.S. Pat. No. 5,315,731, the Humphries toothbrush, U.S. Pat. No. 5,465,450. All of these patents use the method of bending the back of a conventional flat-trimmed toothbrush head to create the designed concave (and convex in the patents of Cheng and Humphries toothbrushes but this will not be discussed here) cylindrical shape of the brushing surface.

A common problem for a toothbrush with a concave cylindrical brushing surface according to these designs is: due to the bending of the back of the toothbrush head, the bristles at the front end of the toothbrush (referred to herinbelow as the 'front end bristles') point backwards, so that the free ends of these bristles are at a greater distance to the foremost point of the toothbrush head (FIG. 7).

Therefore, the outside surfaces of the second molars now become even less accessible for brushing than in the case of brushing with the conventional flat-trimmed toothbrush of the same original shape due to this greater distance, the frontal ridges of the rami here being equally obstructive to the foremost point of the toothbrush head (FIG. 8). This is a serious drawback. This same drawback of the concave toothbrush of these designs makes the cleaning of the inside surfaces and gums of the back molars difficult. Besides, the user may find that a hump-backed toothbrush head of these designs appears too bulky when used in the buccal region.

A toothbrush head design of a different approach is needed to create a toothbrush which has a concave cylindrical brushing surface to suit the outer contours of the dental arches, and this novel toothbrush shall perform well in cleaning all aspects of the teeth as well as massaging and stimulating the gums, when used according to the recommended brushing technique, and it will not have the mentioned shortcomings of the toothbrushes of the bent-back designs. These are the features of the toothbrush head of the present invention.

SUMMARY OF THE INVENTION

Briefly stated the invention involves a toothbrush comprising:

- an elongated head having a longitudinal axis, a front end and a rear end, the head having a lower surface, an upper surface opposite the lower surface and a pair of side surfaces joining the lower and upper surfaces;
- a longitudinal handle part;
- a neck part joining the handle part to the head at the rear end;
- a plurality of bristles, each with a first end anchored to the upper surface and a second free end opposite to the first end, the bristles being organized in tufts, the tufts being arranged in rows generally in the direction of the longitudinal axis and columns generally transverse to the longitudinal axis, including a pair of outer regions, each of which is adjacent a corresponding side surface and includes at least one outer row, and at least one inner row between the outer regions, a front group of tufts being adjacent the front end and including at least three columns of the tufts therein, a rear group of tufts being adjacent the rear end and including at least one column of the tufts therein, and a central group of tufts including the remaining columns of the tufts therein, wherein the tufts of each column in the front and rear groups are substantially equal in height transverse to the longitudinal axis, each column in the central group having a first tuft in one of the outer regions and a second tuft in the other of the outer regions wherein the first and second tufts are substantially equal in height transverse to the longitudinal axis;

a first central plane transverse to the longitudinal axis and centrally located relative to the upper surface;

wherein the tufts in the front and rear groups and in the outer regions of the central group have free ends which together define a first concave cylindrical surface approximating the general curvature of a frontal part of a user's dental arches, and wherein the tufts progressively decrease in height, from a first maximum height adjacent the front end and a second maximum height adjacent the rear end, toward a minimum height at the first central plane;

and, for each column in the central group, the tuft of the inner row is shorter in height in comparison to the tufts of the outer regions.

In one embodiment, the toothbrush further comprises a second central plane transverse to the longitudinal axis and centrally located relative to the upper surface; wherein the tufts in the inner row of the central group have free ends which together define a second surface, the second cylindrical surface being more concave than the first cylindrical surface, wherein the tufts in the inner row of the central group are progressively shorter in height than the tufts in the outer regions transverse to the longitudinal axis and toward the second central plane.

In another embodiment, the toothbrush has tufts in the inner row that are equal in height but shorter than the minimum height of the tufts in the outer regions, thereby to define a plane.

In another aspect of the present invention, there is provided a toothbrush that includes:

an elongated handle with a longitudinal axis and a first and a second end;

an elongated head also with a longitudinal axis and a front and rear end;

a neck joining the second end of the handle and the rear end of the head;

the head has a lower surface, an upper flat surface opposite the lower surface and side surfaces joining the lower and upper surfaces wherein the left and right edges created by the upper surface with the left and right side surfaces are preferably straight and parallel to the longitudinal axis of the head;

a plurality of tufts which includes one outer left row adjacent to the left edge, one outer right row adjacent to the right edge and preferably two inner rows between the outer rows, of bristle are arranged that one end of each bristle is anchored into the upper surface of the head with a free end opposite the anchored end;

the free ends of the bristles have an enveloping surface of concave cylindrical shape which approximates the general concave shape of the outside contour of the frontal part of the upper or lower dental arch so that bristles at the front and rear ends of the head have the greatest heights and they decrease in height progressively towards the center plane between the front and rear ends of the head and bristles transverse to the longitudinal axis of the head have equal heights;

a further modified feature is for the bristles of the inner rows away from the front and the rear ends of the toothbrush head: starting from both ends of the toothbrush head where all bristles have equal heights transverse to the longitudinal axis of the head due to the concave cylindrical shape, rear to these front end bristles of at least three columns of tufts and frontal to the bristles at the rear end of the toothbrush (hereinafter referred to as rear end bristles) of at least one column of tufts, the bristles at the inner rows are shorter in height in comparison to those of the outer rows at the same position transverse to the longitudinal axis of the head.

This modified feature for the bristles at the inner rows away from the ends in one embodiment of the toothbrush head is defined by a second more concave shape: starting from both ends of the toothbrush head where all bristles have equal heights transverse to the longitudinal axis of the head due to the concave cylindrical shape, rear to these front end bristles of at least three columns of tufts and frontal to these rear end bristles of at least one column of tufts, towards the center plane between the rearmost column of the anterior tufts of bristles and the foremost column of tufts located at the rear end of the toothbrush, the bristles at the inner rows are progressively shorter in height in comparison to those of the outer rows at the same position transverse to the longitudinal axis of the head.

An alternative embodiment of the toothbrush head is that the bristles of the inner rows away from the ends of the toothbrush head is defined by a plane: starting from both ends of the toothbrush head where all bristles have equal heights transverse to the longitudinal axis of the head due to the concave cylindrical shape, rear to these front end bristles of at least three columns of tufts and frontal to these rear end bristles of at least one column of tufts, the bristles at the inner rows are in equal height but shorter than the shortest bristles of the outer rows.

BRIEF DESCRIPTION OF THE DRAWINGS

Several preferred embodiments of the invention will now be described, by way of example only, as illustrated in the appended drawings, in which:

FIG. 12 is the plan view, FIG. 13 is the elevation view in the direction of 13 wherein the flesh at the cheek has been removed for clear viewing, and FIG. 14 is the cross-sectional view along 14—14.

DETAILED DESCRIPTION

Figure 1:
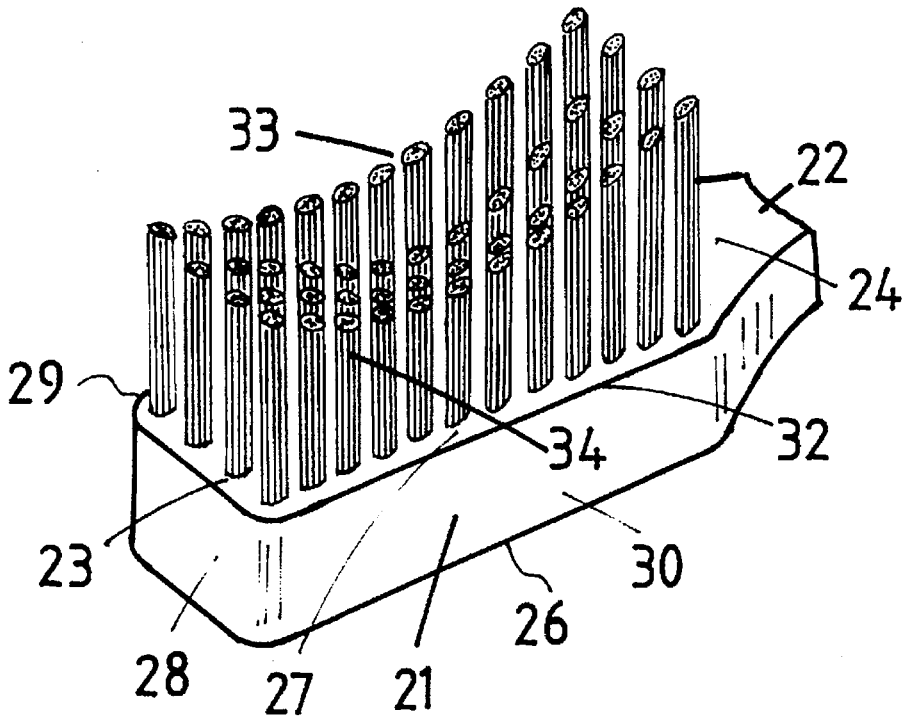
FIG. 1 is a perspective view of the toothbrush head.
Figure 2:
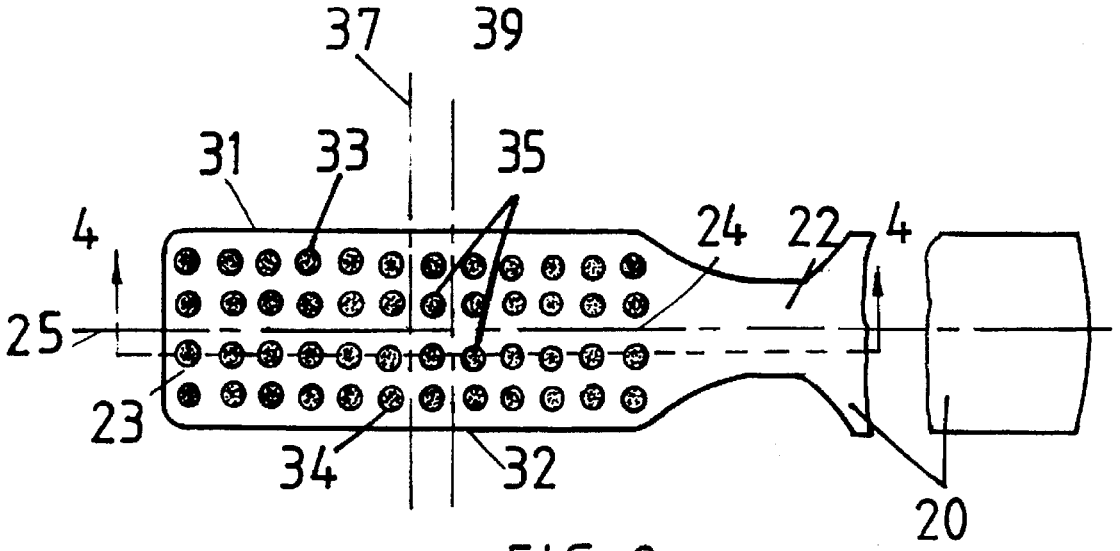
FIG. 2 is a top plan view of the toothbrush according to FIG. 1.

FIGS. 1 and 2 illustrate a toothbrush head 21 with a front end 23, a rear end 24 and a longitudinal axis of the head 25. The rear end 24 of the head is connected to a neck 22. A handle 20 which has a first end and second end and a longitudinal axis, the second end being connected to the neck 22. Head 21 is defined by a lower surface 26, a flat upper surface 27 opposite the lower surface, a front side surface 28, a left side surface 29 and a right side surface 30, all joining the lower and upper surfaces, the left and right edges of the upper surface being 31 and 32.

FIG. 2 provides the best view of the bristle tufts positioned in relation to one another on the head. An outer region containing one row of outer tufts 33 is arranged adjacent to the left edge and one region containing one row of outer tufts 34 is arranged adjacent to the right edge. Between these outer rows of tufts are inner rows of tufts 35 which are equally spaced and in alignment with the outer ones, that is, the tufts are all arranged in columns as well. A first central plane is transverse to the longitudinal axis and is centrally located relative to the upper surface as shown at 37.

Figure 3:
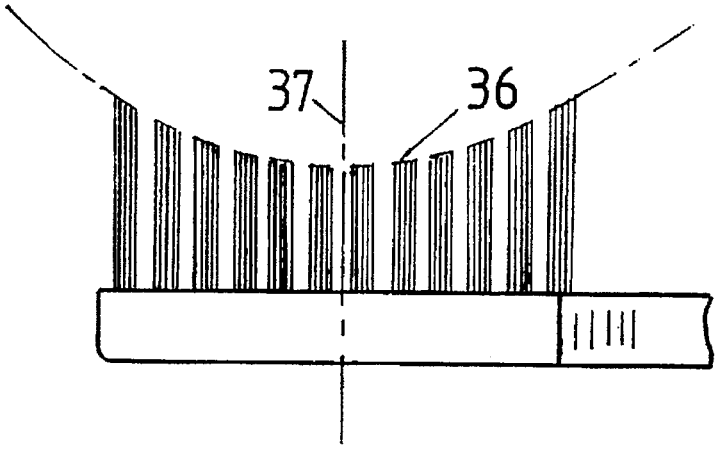
FIG. 3 is a side elevational view according to FIG. 1.

In FIG. 3, the bristles are shown to be substantially perpendicular to the upper surface and the concave curvature 36 is the projection of the concave cylindrical surface which defines the free ends of the bristle tufts at the outer rows also at the front and rear ends of inner rows.

Figure 4:
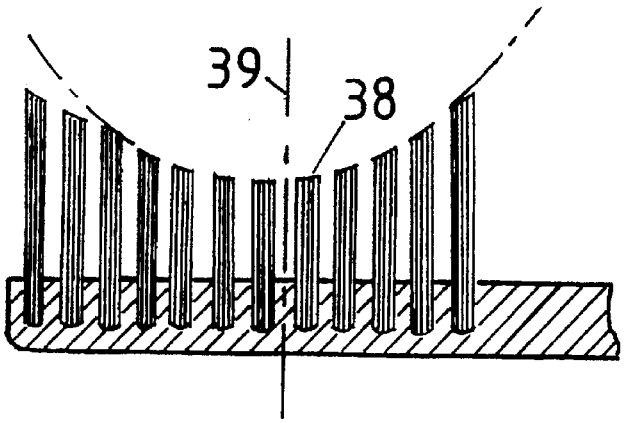
FIG. 4 is a cross-sectional view along 4—4 in FIG. 2 highlighting the second concave curvature defining the free ends of the bristles at the inner rows away from the fontal and rear ends for one embodiment of the toothbrush.

In FIG. 4, the second concave curvature 38 is the projection of the more concave cylindrical surface which defines the free ends of the tufts of the bristles at the inner row away from the front and the rear ends toward a second central plane transverse to the longitudinal axis and centrally located relative to the upper surface as shown at 39.

Figure 5:
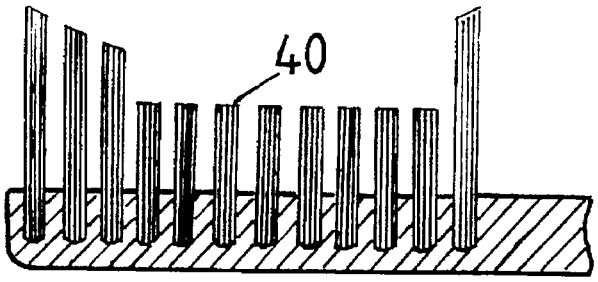
FIG. 5 is also a cross-sectional view along 4—4 in FIG. 2 highlighting the plane surface of the free ends of the bristles at the inner rows away from the fontal and rear ends for an alternative embodiment of the toothbrush.
Figure 6:
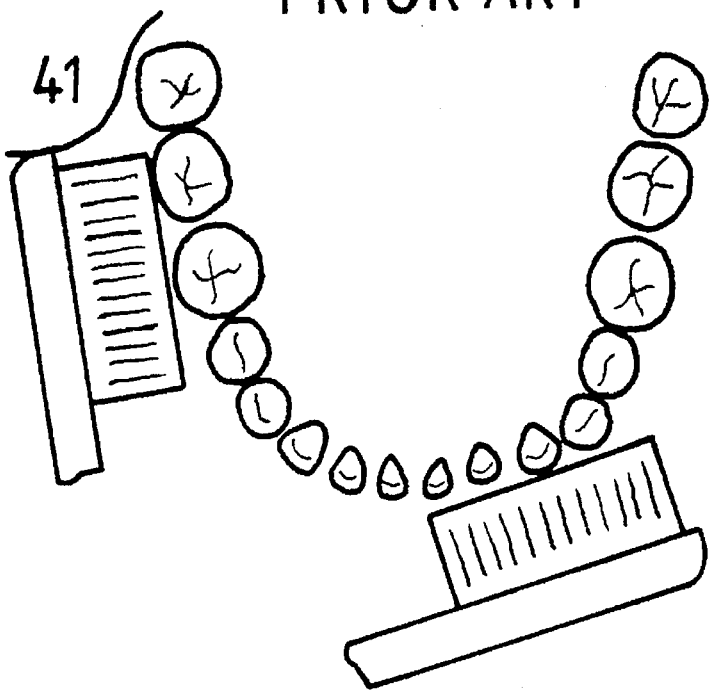
FIG. 6 PRIOR ART
FIG. 6 is the plan view illustrating the limited contact of the conventional flat-trimmed toothbrush with the outside surfaces of the frontal teeth of upper or lower jaw. It also illustrates the limitation of the conventional flat-trimmed toothbrush for accessing the outside surfaces and gums of the second and the third molars both at upper and lower jaw.
Figure 7:
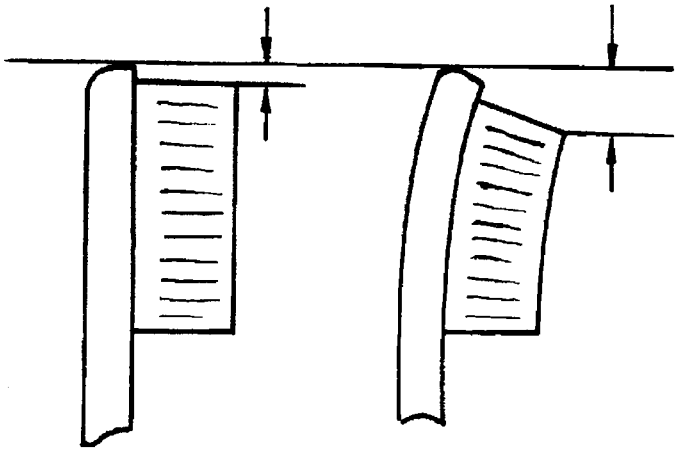
FIG. 7 is the illustration of the distance from the free ends of the front end bristles to the foremost point of the toothbrush head on the left for the configuration that the back of the original head is straight, on the right for the configuration that the back of the same original head now has been bent.
Figure 8:
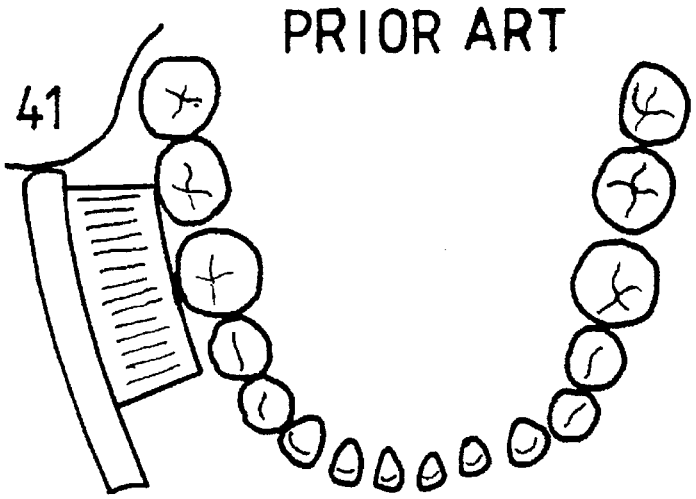
FIG. 8 is the plan view illustrating the even less accessibility of the concave toothbrush of bent head than the conventional flat-trimmed toothbrush to the outside surfaces and gums of the second molars.

In FIG. 5, the straight segment of line 40 is the projection of the plane which defines the free ends of the tufts of bristles at the inner row away from the front and the rear ends for an alternative embodiment of this invention.

Since the concave brushing surface of the toothbrush of this invention has a curvature which approximates that of the frontal part of the upper or lower dental arch, it provides an optimal contact with the dental surfaces when being used to brush the outside surfaces of the teeth and gums at that region (FIG. 9), following the recommended technique of toothbrushing.

Figure 9:
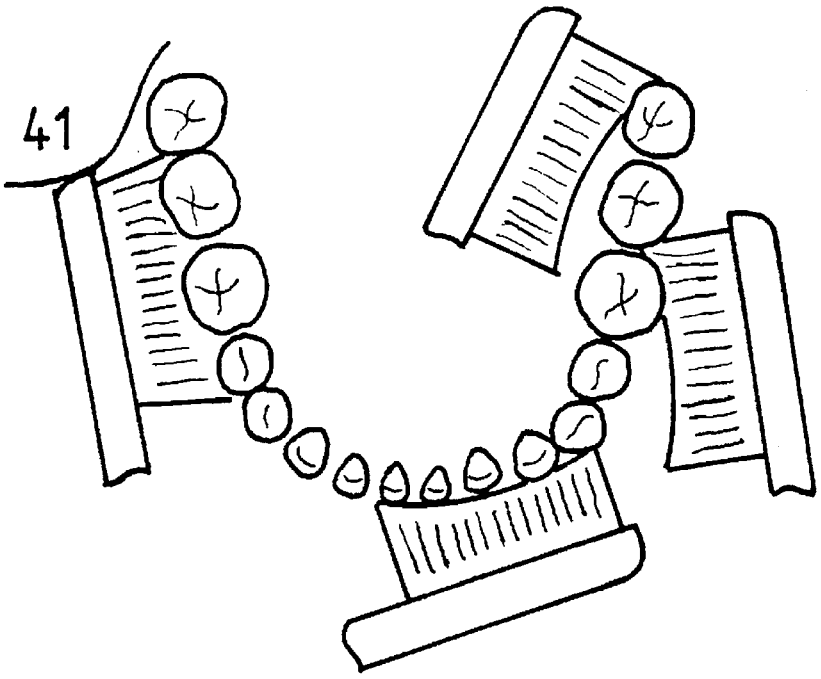
FIG. 9 is the plan view illustrating the cleaning action of the toothbrush of this invention on the surfaces of the teeth at the upper or lower jaw at the labial, buccal and posterior region.

For brushing the outside surfaces of the teeth and gums at the buccal regions where the dental curvature is less pronounced, the bristle tufts have a tendency under pressure to slightly separate with one another at their free ends, therefore resulting a less pronounced curvature to still comply well to the dental surface and, advantageously, the front end bristles now point forward so that their tips can reach farther back on the outside surfaces and gums of the back molars (FIG. 9).

An alternative way of cleaning this region using the toothbrush of this invention will be discussed later according to the illustration of FIGS. 12, 13 and 14. Because of the conformation of bristles to the contours of dental arches and hence that of the gums, the pressure on the gums is much more evenly distributed, therefore resulting in better massaging for the gums. Since horizontal overlapping of contacts with dental surfaces between adjacent brushing steps is well granted, the teeth are much better cleaned.

A further advantage of the toothbrush of this invention is: the free ends of bristles at both ends of the head form sharp wedges of much less than 90 degrees (end bristles on both the conventional flat-trimmed and the bent concave toothbrushes form 90 degree wedge) which can be easily employed to reach the indented areas between adjacent teeth (FIG. 9) which are difficult to access using the flat-trimmed and bent-backed concave toothbrush. The front sharp wedge can easily reach the back surfaces of the last molars (FIG. 9). It can also reach the gumline at the outside surfaces of the back molars.

Figure 12:
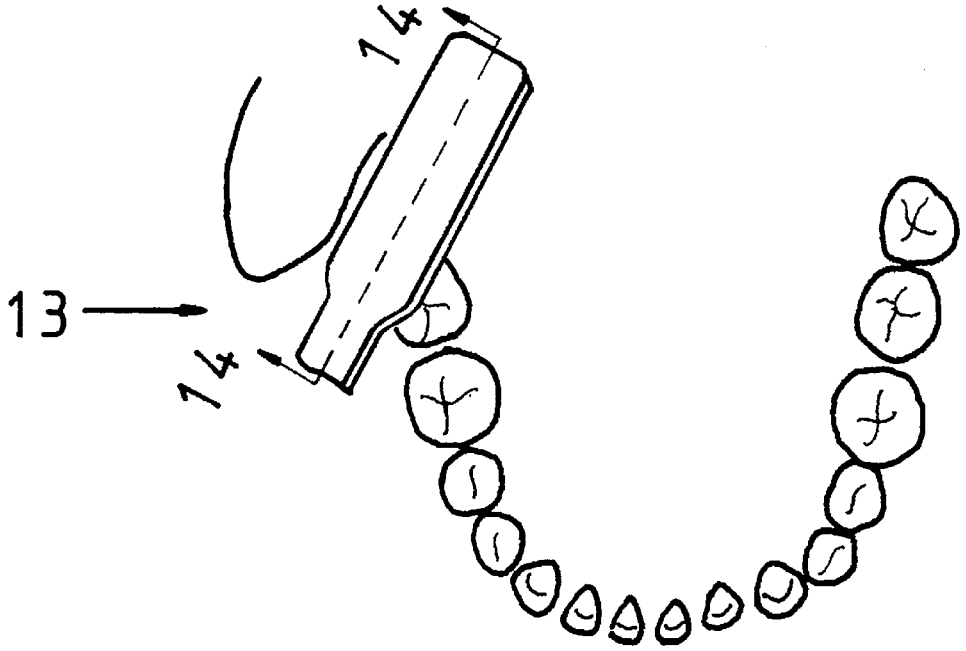
FIGS. 12, 13 and 14 illustrate the cleaning action of the toothbrush of this invention by striding on a third molar at the lower jaw, with rear side of the head inclining upwards, whole head tilting towards the cheek and short strokes along the longitudinal axis of the toothbrush head for cleaning the outside and back surfaces and gums of this molar, where
Figure 13:
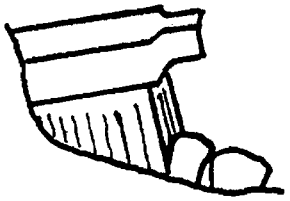
Figure 14:
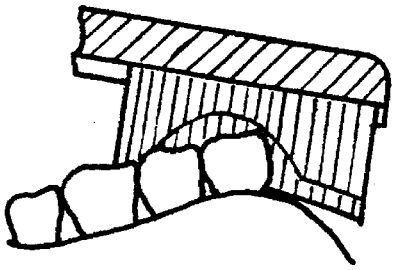

An alternative way of cleaning the outside surfaces and gums of the third molars is to take advantage of the greater heights of the outer rows in comparison to the inner rows of this toothbrush mentioned earlier by letting the bristles stride on a third molar, with the free ends of the bristles at the inner row, whose heights are shorter, to be in contact with the biting surface of the molar, inclining the rear end of the toothbrush head upward, tilting slightly the whole head towards the cheek and applying short brushing strokes along the longitudinally axis of the toothbrush head (FIGS. 12, 13 and 14).

Figure 10:
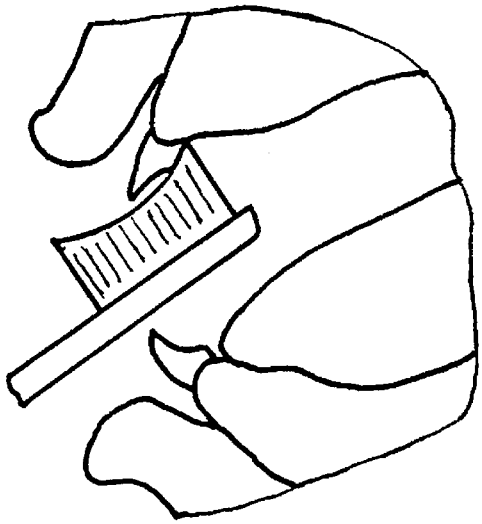
FIG. 10 is a side cross-sectional view of the cleaning action of the toothbrush of this invention on the inside surfaces and gums of the frontal teeth.
Figure 11:
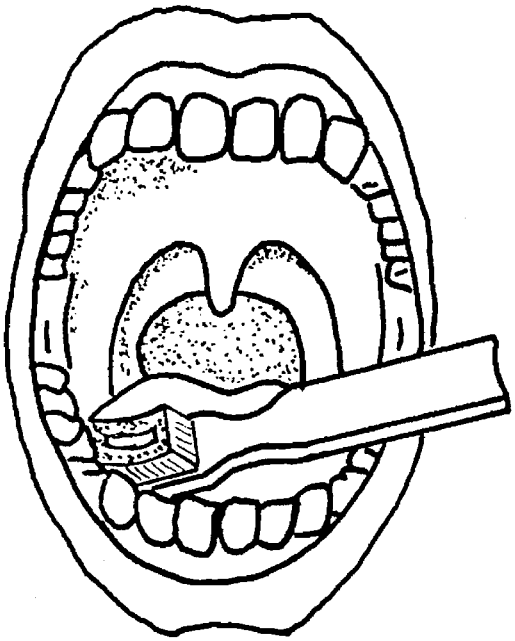
FIG. 11 is a perspective view illustrating the cleaning action of the toothbrush of this invention on the inside surfaces and gums of the molars at the lower jaw.

For brushing the inside surfaces of the teeth and gums both at upper and lower jaws, the sharp frontal wedge of the toothbrush head can access to the most difficult areas at gumlines for incisors, canines (FIG. 10), and for molars at the lower jaw in particular (FIG. 11).

Improved performance is reached by introducing the second more concave shape, or in general, shortened heights, of the bristles at the inner rows which essentially gives the bristles of the two outer rows more flexibility for massaging and stimulating the gum. It also provides a better ability for the free ends of the bristles of the outer rows to probe into the gumline to clean the gingival crevices of the teeth, to penetrate into the contact areas between teeth, therefore greatly increases the effectiveness of dental cleaning.

The present invention may be embodied in slightly altered forms without departing fundamentally from the essential characteristics stated above. For example, one alternative embodiment proposes that the front side surface of the toothbrush head is round and the anterior tufts of bristles are arranged in a radial pattern. Still another alternative embodiment proposes that the head is oval shaped. Still another alternative embodiment proposes that the front end bristles are arranged inclining towards the front end of the head so as to have even better access to the difficult areas in the buccal, posterior and lingual regions of the molars. Still another alternative embodiment proposes that tufts of bristles of the two outer rows are arranged inclining outwards for easy access to the gums. The scope of the invention, therefore, is indicated by the following claims.

I claim:

1. A toothbrush comprising:

an elongated head having a longitudinal axis, a front end and a rear end, the head having a lower surface, an upper surface opposite said lower surface and a pair of side surfaces joining the lower and upper surfaces;

a longitudinal handle part;

a neck part joining said handle part to said head at said rear end;

a plurality of bristles, each with a first end anchored to said upper surface and a second free end opposite to said first end, said bristles being organized in tufts, said tufts being arranged in rows generally in the direction of said longitudinal axis and columns generally transverse to said longitudinal axis, including a pair of outer regions, each of which is adjacent a corresponding side surface and includes at least one outer row, and at least one inner row between said outer regions, a front group of tufts being adjacent said front end and including at least three columns of said tufts therein, a rear group of tufts being adjacent said rear end and including at least one column of said tufts therein, and a central group of tufts including the remaining columns of said tufts therein, wherein the tufts of each column in said front and rear groups are substantially equal in height transverse to said longitudinal axis, each column in said central group having a first tuft in one of said outer regions and a second tuft in the other of said outer regions wherein said first and second tufts are substantially equal in height transverse to said longitudinal axis;

a first central plane transverse to said longitudinal axis and centrally located relative to said upper surface;

wherein the tufts in said front and rear groups and in the outer regions of said central group have free ends which together define a first concave cylindrical surface approximating the general curvature of a frontal part of a user's dental arches, and wherein the tufts progressively decrease in height, from a first maximum height adjacent said front end and a second maximum height adjacent said rear end, toward a minimum height at said first central plane;

and, for each column in said central group, the tuft of said inner row is shorter in height in comparison to the tufts of said outer regions.

2. A toothbrush according to claim 1 further comprising a second central plane transverse to said longitudinal axis and centrally located relative to said upper surface;, wherein the tufts in said inner row of said central group have free ends which together define a second cylindrical surface, said second cylindrical surface being more concave than said first cylindrical surface, wherein the tufts in the inner row of said central group are progressively shorter in height than the tufts in said outer regions transverse to said longitudinal axis and toward said second central plane.

3. A toothbrush according to claim 2 wherein said rows include a pair of outer rows and a pair of inner rows therebetween.

4. A toothbrush according to claim 2 wherein said upper surface is flat.

5. A toothbrush according to claim 2 wherein said bristles are substantially perpendicular to said upper surface.

6. A toothbrush according to claim 1 wherein the tufts in said inner row are equal in height but shorter than the minimum height of the tufts in said outer regions, thereby to define a plane.

7. A toothbrush according to claim 6 wherein said rows include a pair of outer rows and a pair of inner rows therebetween.

8. A toothbrush according to claim 6 wherein said upper surface is flat.

9. A toothbrush according to claim 6 wherein said bristles are substantially perpendicular to said upper surface.

10. A toothbrush according to claim 1 wherein said rows include a pair of outer rows and a pair of inner rows therebetween.

11. A toothbrush according to claim 1 wherein said upper surface is flat.

12. A toothbrush according to claim 1 wherein said bristles are substantially perpendicular to said upper surface.

13. A toothbrush according to claim 1 wherein said first and second maximum heights are substantially equal.

* * * * *